US009217387B2

(12) United States Patent
Loeffler et al.

(10) Patent No.: US 9,217,387 B2
(45) Date of Patent: Dec. 22, 2015

(54) METHOD FOR REGULATING AN INTERNAL COMBUSTION ENGINE, COMPUTER PROGRAM AND CONTROL UNIT

(75) Inventors: Axel Loeffler, Backnang (DE); Juergen Haering, Stuttgart (DE); Wolfgang Fischer, Gerlingen (DE); Roland Karrelmeyer, Bietigheim-Bissingen (DE); Gerald Graf, Gaertrinien (DE)

(73) Assignee: ROBERT BOSCH GMBH, Stuttgart (DE)

( * ) Notice: Subject to any disclaimer, the term of this patent is extended or adjusted under 35 U.S.C. 154(b) by 2141 days.

(21) Appl. No.: 12/332,828

(22) Filed: Dec. 11, 2008

(65) Prior Publication Data

US 2009/0182485 A1 Jul. 16, 2009

(30) Foreign Application Priority Data

Jan. 15, 2008 (DE) ..... 10 2008 004 361

(51) Int. Cl.

| | |
|---|---|
| ***F02D 41/00*** | (2006.01) |
| ***F02D 41/30*** | (2006.01) |
| ***F02D 35/02*** | (2006.01) |

(Continued)

(52) U.S. Cl.

CPC ..... *F02D 41/3035* (2013.01); *F02D 35/023* (2013.01); *F02D 35/024* (2013.01); *F02D 35/028* (2013.01); *F02D 41/3064* (2013.01); *F02D 41/0002* (2013.01); *F02D 41/006* (2013.01); *F02D 41/008* (2013.01); *F02D 41/1454* (2013.01); *F02D 41/402* (2013.01); *F02D 2041/001* (2013.01); *F02D 2041/1412* (2013.01); *F02D 2041/1433* (2013.01)

(58) Field of Classification Search

CPC ..... F02D 43/00; F02D 43/04; F02D 2200/02; F02D 41/1433; F02D 35/023; F02D 35/024; F02D 35/028; F02D 41/3035; F02D 41/0002; F02D 41/006; F02D 41/008; F02D 41/1451; F02D 41/402; F02D 2041/1412; F02D 2041/001

USPC ..... 701/101–106

See application file for complete search history.

(56) References Cited

U.S. PATENT DOCUMENTS

| | | | | |
|---|---|---|---|---|
| 7,509,932 | B2 * | 3/2009 | Hara et al. | 123/90.15 |
| 7,877,195 | B2 * | 1/2011 | Angeby | 701/102 |
| 8,155,863 | B2 * | 4/2012 | Hsu et al. | 701/104 |

(Continued)

FOREIGN PATENT DOCUMENTS

| | | |
|---|---|---|
| JP | 2001-193505 | 7/2001 |
| JP | 2001-323832 | 11/2001 |

(Continued)

*Primary Examiner* — Hieu T Vo
*Assistant Examiner* — Arnold Castro
(74) *Attorney, Agent, or Firm* — Kenyon & Kenyon LLP

(57) ABSTRACT

A method for regulating an internal combustion engine that is operable, at least in a part-load range, in an operating mode with auto-ignition and a combustion process of which is influenced by a manipulated variable, the method includes the steps of determining a desired value of a combustion position feature of the combustion process; determining the manipulated variable by predictive closed-loop control based on a modeling of the combustion position feature as a function of the manipulated variable in the combustion process; and determining, as the manipulated variable, a value at which the difference between the desired value of the combustion position feature and a model-based predicted combustion position feature is minimized.

5 Claims, 6 Drawing Sheets

(51) Int. Cl.
*F02D 41/14* (2006.01)
*F02D 41/40* (2006.01)

(56) References Cited

U.S. PATENT DOCUMENTS 8,406,979 B2 * 3/2013 Loeffler et al. ..... 701/102
8,434,456 B2 * 5/2013 Fischer et al. ..... 701/103
2001/0045200 A1 * 11/2001 Urushihara et al. ..... 123/430
2007/0089697 A1 * 4/2007 Hara et al. ..... 123/90.15
2008/0105233 A1 * 5/2008 Koeller et al. ..... 701/103
2009/0132145 A1 * 5/2009 Angeby ..... 701/102

FOREIGN PATENT DOCUMENTS

JP 2007-113485 5/2007
JP 2007-177723 7/2007

* cited by examiner

METHOD FOR REGULATING AN INTERNAL COMBUSTION ENGINE, COMPUTER PROGRAM AND CONTROL UNIT

FIELD OF THE INVENTION

The present invention relates to a method for regulating an internal combustion engine, especially an internal combustion engine that is operable, at least in a part-load range, in an operating mode with auto-ignition. The present invention further relates to a computer program and to a control unit for carrying out such a method.

BACKGROUND INFORMATION

A comparatively new development that has become known among gasoline engine combustion methods is the HCCI (Homogeneous Charge Compression Ignition) method, which is also referred to as the CAI (Controlled Auto Ignition) method. The CAI method has a significant potential to save fuel compared to conventional spark-ignition operation.

CAI engines operate with a homogeneously (uniformly) distributed mixture of fuel and air. Ignition is initiated in this case by the rising temperature as compression takes place and by any free radicals and intermediates or precursors of the preceding combustion process that have remained in the combustion chamber. Unlike the case of a conventional gasoline engine, this auto-ignition is completely desirable and forms the basis of the principle of why a spark plug is not needed in CAI operation. Outside a given part-load range, a spark plug is needed.

In CAI operation, the charge composition is ideally so uniform that combustion begins simultaneously throughout the combustion chamber. To produce stable CAI operation, internal or external exhaust gas recirculation or exhaust gas retention may be employed. By exhaust gas recirculation/retention it is to a certain extent possible to monitor the combustion position.

CAI combustion produces a comparatively low combustion temperature with very homogeneous mixture formation, which leads to a large number of exothermic centers in the combustion chamber and therefore to a combustion process that proceeds very evenly and rapidly. Pollutants such as NOx and soot particles may accordingly be avoided almost completely in comparison with stratified operation. It is therefore possible where appropriate to dispense with expensive exhaust gas treatment systems such as an NOx storage catalyst. At the same time, efficiency is increased in comparison with spark-ignited combustion.

CAI engines are as a rule equipped with direct gasoline injection and a variable valve train, with a distinction being made between fully variable and partially variable valve trains. An example of a fully variable valve train is EHVC (electro-hydraulic valve control) and an example of a partially variable valve train is a camshaft-controlled valve train with 2-point lift and phase adjuster.

In CAI engines, regulation of dynamic engine operation is a great challenge. As used throughout the specification, the expression "dynamic engine operation" may refer, on one hand, to changing of the operating mode between the auto-ignition operating mode (CAI mode) and the spark-ignition operating mode (SI mode), and on the other hand, may also refer to load changes within the CAI mode. Changes to the operating point in dynamic engine operation should take place as steadily as possible with respect to torque and noise, which, however, proves difficult on account of the factors described below:

In CAI operation, there is no direct trigger in the form of a spark-ignition to initiate combustion. Accordingly, the combustion position has to be ensured by very carefully coordinated control of the injection and air system at every cycle of a dynamic changeover.

A further difficulty arises when changing between SI operation and CAI operation: In SI operation, the residual gas compatibility is comparatively low and therefore as little residual gas as possible should be retained in the cylinder. In contrast, CAI operation requires a comparatively large proportion of residual gas. It is therefore not possible for the proportion of residual gas to be gradually raised "in preparation", as it were, before a change from SI operation to CAI operation, and conversely, when changing from CAI operation to SI operation, the proportion of residual gas may not already be lowered in advance since this would lead to considerable disturbance of the combustion behavior to the point of misfiring.

The effect described above also means that, at a changeover from SI operation to CAI operation under the control of a conventional linear controller, too much residual gas and/or residual gas that is too hot is generally retained for the first CAI cycle. Consequently, combustion takes place too early, that is, is too loud to the point of knocking. That in turn means that the change in type of operation entails troublesome noise development.

Similar phenomena also occur at load changes within CAI operation. At an abrupt change from a lower to a higher load point, too little residual gas and/or residual gas that is too cold is retained in the first cycle following the load change, which leads to combustion that is too late (compared with the desired value) to the point of misfiring. In the reverse case of an abrupt change from a higher to a lower load value, combustion occurs by contrast too early and too loudly.

There is therefore a need for an improved method for regulating dynamic engine operation of engines that are operable, at least in a part-load range, in an operating mode with auto-ignition.

SUMMARY OF THE INVENTION

A method for regulating an internal combustion engine that is operable, at least in a part-load range, in an operating mode with auto-ignition and the combustion process of which may be influenced by a manipulated variable, comprises the steps of:

(a) determining a desired value of the combustion position feature of the combustion process; and (b) determining the manipulated variable using predictive closed-loop control which is based on a modeling of the combustion position feature as a function of the manipulated variable in the combustion process, wherein there is determined as the manipulated variable a value at which the difference between the desired value of the combustion position feature and the model-based predicted combustion position is minimized.

The present invention utilizes the concept of subjecting the combustion process of an internal combustion engine with auto-ignition to predictive closed-loop control, using a combustion position feature as a reference variable. In the case of a gasoline engine operated in CAI operation or in SI operation depending on the operating point (so-called CAI engine), improved regulation may therefore be achieved in dynamic operation since the predictive closed-loop control takes into consideration the coupling of the combustion process from cycle to cycle and thus makes rapid regulation possible, with misfiring being avoided, not only in the case of load changes but also in the case of changing between CAI operation and SI operation. Additionally, in the case of diesel engines, advantageous regulation of the combustion process at load changes may be implemented using this predictive closed-loop control. Another reason why a combustion position feature is used in the present invention as a reference variable is that the combustion position is closely linked to noise development, and therefore the noise behavior of the engine may be controlled indirectly by suitable open-loop/closed-loop control of the combustion position. It is thus possible to avoid troublesome noise development during a change in the type of operation or also in the case of a load change within a type of operation.

As used throughout the specification, the expression "combustion position feature" refers to any feature of the combustion process that is indicative of the combustion position, that is, a feature that correlates with combustion position. The combustion position is the crankshaft angle at which a specific quantity of the combustion energy of a combustion cycle has been converted in a cylinder of the internal combustion engine. The combustion position feature may, therefore, be the combustion position itself. The combustion position feature may also be the 50% mass fraction burnt, which corresponds to a crankshaft angle at which about 50% of the combustion energy of a combustion cycle has been converted in the cylinder of the internal combustion engine. Alternatively, other features may also be used as the combustion position feature, such as the position or the crankshaft angle of the maximum cylinder pressure or also of the maximum cylinder pressure gradient. There is also the possibility of generating combustion position features from other sensor signals, for example from the high time resolution engine speed, from a low-frequency structure-borne sound signal or from an ion current signal, and of using these as reference variables correlating with the combustion position.

If the internal combustion engine is a gasoline engine that is operable in a first part-load range in a first operating mode with spark-ignition and in a second part-load range in a second operating mode with auto-ignition, the following steps may be performed:

(c) determining whether the internal combustion engine is being operated in the first or the second operating mode; and (d) performing the above-mentioned steps (a) and (b) if it is determined that the internal combustion engine is being operated in the second operating mode or that a changeover from the first to the second operating mode or from the second to the first operating mode is taking place. Accordingly, the predictive closed-loop control is carried out only in CAI operation and at a changeover between SI and CAI operation, and therefore resources in the control unit may be saved.

The manipulated variable may correspond to a crankshaft angle at which an intake or exhaust valve of a cylinder of the internal combustion engine is opened or closed. Such an intervention in the gas exchange processes (removal of exhaust gas and supplying of air) is suitable for influencing the combustion process. The manipulated variable may, however, also correspond to a time at which fuel is injected or to an apportionment ratio of the injected fuel over a plurality of injections (for example pilot injection and main injection).

The model may be a data-driven model that predicts the combustion position feature as a linear function of the manipulated variable. By using suitable maps, calculation of the manipulated variable may be carried out in a simple manner with simple algebraic equations. Accordingly, comparatively few resources are taken up in the control unit.

As an alternative, the model may be a physical model that predicts the combustion position feature by reference to the predicted changing of state features of the combustion process taking into consideration a planned control intervention on the basis of the manipulated variable. Such a physical model takes up comparatively more computational resources in the control unit but provides a more accurate picture of the underlying physical process. Consequently, it is possible to implement an improved determination of the underlying physical parameters using the physical model in a simple manner without it being necessary for maps, for example, to be laboriously redefined.

The manipulated variable may, in addition, be subjected to cylinder-individual closed-loop control. The cylinder-individual closed-loop control may, for example, be a continuous, linear closed-loop control, as may be achieved by a PID controller or the like. This has the advantage that the predictive closed-loop control is able to act in a similar manner from cycle to cycle for all cylinders and thus permits rapid regulation taking into consideration the coupling between the cycles, whereas cylinder-individual continuous closed-loop control works comparatively slowly, but permits finer regulation with respect to cylinder-individual differences. Therefore, rapid and precise regulation over all cylinders is made possible.

The method may also have the following steps:

(e) determining a difference between an actual value of the combustion position feature, which actual value is ascertained (for example derived from measurable values) for a combustion cycle, and the predicted value of the combustion position feature for the same combustion cycle;

(f) determining a (potentially slowly varying) offset correction value on the basis of the difference determined in step (e); and (g) correcting the desired value of the combustion position feature by the offset correction value.

There is accordingly provided a method with which it is possible to compensate for cylinder-individual differences in the combustion behavior. In particular, the control unit is accordingly able to react on the one hand to differences in the combustion behavior between the cylinders due to the differing geometry or differing ambient conditions of the individual cylinders, and on the other hand to long-term changes in the combustion behavior resulting from component aging or the like.

To determine the offset correction value, the difference determined in step (e) may be multiplied by a constant, K and the product obtained by the multiplication may be integrated over the combustion cycles. It is thus possible to eliminate statistical variations in the combustion position feature. The offset correction value MFB50_offset is less sensitive to statistical variations when the constant K is small. The constant K may be, for example, from 0.0001 to 0.1.

To determine the offset correction value it is also possible to subject the difference determined in step (e) to low-pass filtering. It is also possible to average the difference determined in step (e) over a plurality of combustion cycles in order to determine the offset correction value. Accordingly, it is possible to eliminate statistical variations in the combustion position feature.

The offset correction value may be determined for each cylinder of the internal combustion engine individually, and cylinder-individually corrected desired values may be determined on the basis of the offset correction values determined cylinder-individually. It is thus possible to take cylinder-individual differences into consideration.

There is further provided a computer program having program code means, wherein the program code means are configured to carry out the method according to any one of the preceding claims when the computer program is executed with a program-controlled device.

In addition, a computer program product having program code means is provided, which program code means are stored on a computer-readable data medium in order to carry out the above-described method when the program product is executed on a program-controlled device.

A control unit according to the present invention for an internal combustion engine is programmed for use in the above-described method.

BRIEF DESCRIPTION OF THE DRAWINGS

FIG. 2A shows a plot of the cylinder pressure, p as a function of the crankshaft angle; FIG. 2B shows a plot of the gas mass, m in the combustion chamber as a function of the crankshaft angle; and FIG. 2C shows a plot of the gas temperature, T in the combustion chamber as a function of the crankshaft angle.

DETAILED DESCRIPTION

Figure 1A:
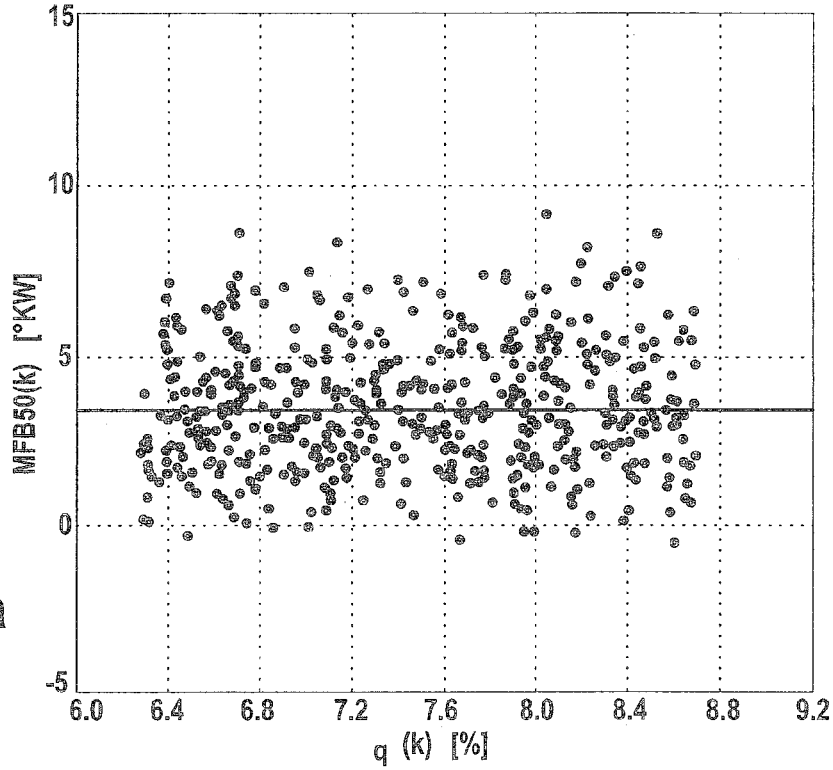
FIGS. 1A and 1B respectively show the dependent relationship of the 50% mass fraction burnt, MFB50 in a cycle, k to the quantity of fuel injected in the same cycle k, and the dependent relationship of the 50% mass fraction burnt MFB50 in the cycle k to the quantity of fuel injected in a preceding cycle, k−1.

Exemplary embodiments of a method and control unit according to the present invention will be explained with reference to the accompanying drawings. Unless stated otherwise, identical or functionally identical elements have been provided with the same reference numerals throughout the figures of the drawings.

The present invention will be explained with reference to a gasoline engine that is operable selectively or in dependence on operating point in CAI operation and in SI operation. It is, however, generally applicable to engines that are operable at least in a part-load range in an operating mode with autoignition, that is to say, for example, that the present invention is also applicable to diesel engines.

In accordance with one exemplary embodiment, first the desired value of the combustion position, which is a feature (combustion position feature) of the combustion process, is determined and is then fed as a reference variable to a predictive closed-loop control system. At the output side of the predictive closed-loop control system, a manipulated value or a correction intervention in a manipulated value is determined with which the controlled system, that is, the combustion process, may be influenced.

In the present invention, there come into consideration as manipulated variables, all adjustable variables with which the combustion process may be influenced. Suitable manipulated values are, for example, variables indicative of the course of the injection process, such as, for example, the start of the main injection (SOI_MI), apportionment of fuel between pilot injection and main injection (q_PI/q_MI), or also variables that determine the air supply, such as, for example, crankshaft angle on opening of the exhaust valve (EVO) or closing of the exhaust valve (EVC) or crankshaft angle on opening or closing of the intake valve (IVO or IVC). In the case of a fully variable valve train, the manipulated variables relating to the air supply may be set individually. In the case of a partially variable valve train, they may, where applicable, be in a predetermined relationship to one another. Hereinafter, manipulated variables relating to the air supply (that is, EVO, EVC, IVO, IVC or also ratios of those variables to one another) are collectively referred to as manipulated variable, "EV". It is assumed that it is possible for the relevant intervention to be achieved from cycle to cycle.

A suitable reference variable is especially the 50% mass fraction burnt (MFB50), which gives the crankshaft angle at which 50% of the combustion energy of a combustion cycle has been converted. Further possible reference variables are the mean indicated torque, the indicated mean pressure (pmi) or the maximum pressure gradient in the cylinder (dp_max), which are closely related to the combustion position. It has been found that, in CAI engines, the combustion position is closely linked to noise development, it generally being the case that early combustion leads to high noise emissions. Furthermore, serious drops in indicated torque do not occur unless combustion takes place too late or fails to occur. Consequently, in the examples which follow, the 50% mass fraction burnt MFB50 is used as the reference variable. It will be appreciated that as an alternative it is also possible to use as the reference variable a feature indicative of the crankshaft angle at which a specific percentage (for example 30% or 70%) of the combustion energy has been converted.

Two models on which model-based predictive closed-loop control according to the exemplary embodiments may be based are described by way of example below.

Data-Driven Model:

Data-driven models are also referred to as black box models since they map input variables onto output variables without explicitly modeling the underlying physical process. A data-driven model of this kind may be obtained on the basis of measurements of the input variables (that is, of the manipulated variables, such as, for example, EV, SOI_MI, q_PI/q_MI, and of the state parameters, such as, for example, cylinder pressure or features calculated on the basis of cylinder pressure, etc.) relating to the output variables (that is, especially the combustion position feature used as the reference variable, for example, MFB50). The combustion features used therein may be determined by measurements in the cylinder chamber, suitable measurements including cylinder pressure measurements, or also by measurements with a lambda sensor in the exhaust gas train. The manipulated variables are subjected to certain variations, such as, for example, sinusoidal, sawtooth and/or random stimuli, and correlation curves between the input variables and the output variables may be determined using an identification algorithm.

Expressed in general terms, the 50% mass fraction burnt in the cycle k is a function of the manipulated variables for the cycle k and of the state parameters of the preceding cycle k−1:

$$MFB50(k)=f(EV(k), SOI_MI(k), q_PI/q_MI(k), \ldots pmi(k-1), MFB50(k-1) \ldots) \quad \text{(Eq. 1)}$$

In the cycle k, the 50% mass fraction burnt MFB50 (k) essentially depends, therefore, on the manipulated variables of the same cycle and on the state variables of the preceding cycle (k−1). If those variables are known, therefore, it is possible to predict the 50% mass fraction burnt MFB50 in the cycle k. That predicted value is referred to hereinafter as MFB50_pred(k).

Equation 1 is non-linear, which means that terms of a higher order are also included in the equation. It is, however, possible for Equation 1 to be linearized in parts. For this, the correlation curves determined are subjected to a linearization in the respective operating point, it being possible for the operating point to be given, for example, by the engine speed and the instantaneous load. The following Equation 2 shows a simple example of such a linearized model:

$$MFB50_pred(k)=a1\cdot EV(k)+a2\cdot q_MI(k-1)+a3\cdot pmi(k-1)+a4\cdot MFB50(k-1) \quad \text{(Eq. 2)}$$

In Equation 2, MFB50_pred(k) gives the predicted 50% mass faction burnt in the cycle k, EV(k) is the manipulated variable with regard to residual gas retention and/or air supply admitted to the internal combustion engine in the cycle k, pmi(k−1) is the indicated mean pressure determined for the preceding cycle, and MFB50 (k−1) denotes the real actual value, or the actual value derived from measurements, of the 50% mass fraction burnt in the cycle k−1. Equation 2 describes, therefore, a prediction value for the 50% mass fraction burnt in the cycle k in the case of a planned control intervention EV(k) in that cycle, the quantity of fuel injected in the preceding cycle q_MI(k−1) and the features pmi(k−1) and MFB50 (k−1) of the preceding cycle. By taking the value pmi into consideration, the model is supported by combustion chamber information from the cylinder pressure signal. The parameters a1, a2, a3 and a4 are determined by the above-mentioned linearization and are stored in maps, for example as a function of the operating point (engine speed, load). It should be noted that, in order to facilitate a clearer understanding, a highly simplified model has been described. In reality however, further combustion parameters (temperature, pressure characteristic, etc.) and control interventions (injection profile or the like) may also be taken into consideration to obtain a more accurate prediction value MFB50. In addition, it is equally possible to relate the model to the changing of the respective variables. The following equation is an example of that instance:

$$MFB50_pred(k)=MFB50_\text{desired}(k)+b1\cdot(EV(k)-EV_\text{control}(k))+b2\cdot\Delta q_MI(k;k-1)+b3(pmi(k-1)-pmi_\text{desired}(k))+b4\cdot(MFB50(k-1)-MFB50_\text{desired}(k)) \quad \text{(Eq. 3)}$$

In Equation 3, MFB50_desired(k) and pmi_desired(k) are the desired values of the combustion position and the mean indicated cylinder pressure, respectively, in the cycle k for a given steady-state operating state: they are therefore operating-point-dependent. The desired values MFB50_desired and pmi_desired are determined in the application phase using a representative application engine. They may accordingly also be regarded as expected values, that is, as values obtained on average over all the cylinders. pmi(k−1) and MFB(k−1) give the actual indicated mean pressure and the combustion position in the cycle k−1.

EV_control(k) gives the EV control value in the operating point of cycle k. The difference between EV(k) and EV_control(k) corresponds to a correction value ΔEV(k) for the manipulated variable EV. Δq_MI(k;k−1)=(q_MI(k)−q_MI(k−1)) gives the change in the injection quantity from cycle k−1 to cycle k. Equation 3 thus takes into consideration changes in the quantity of fuel injected. It should further be noted that, for simplicity, it is assumed that there is no change in the time at which the main injection SOI takes place. In other words, the time at which the main injection SOI takes place is fixed at a certain crankshaft angle in this highly simplified model. The parameters b1, b2, b3 and b4 are also determined by the above-mentioned linearization and are stored in maps, for example, as a function of the operating point (engine speed, load).

As indicated above, ΔEV(k)=(EV(k)−EV_control(k)). Correspondingly, the following definitions are obtained:

$$\Delta pmi(k-1)=pmi(k-1)-pmi_\text{desired}(k) \quad \text{(Eq. 4a)}$$

$$\Delta MFB50(k-1)=MFB50(k-1)-MFB50_\text{desired}(k) \quad \text{(Eq. 4b)}$$

$$\Delta MFB50_\text{pred}(k)=MFB50_pred(k)-MFB50_\text{desired}(k) \quad \text{(Eq. 4c)}$$

From this it follows that:

$$\Delta MFB50_pred(k)=1\cdot\Delta EV(k))+b2\cdot\Delta q_MI(k;k-1)+b3\cdot\Delta pmi(k-1)+b4\cdot\Delta MFB50(k-1) \quad \text{(Eq. 5)}$$

Equation 5 describes, therefore, the behavior of the internal combustion engine as a function of the manipulated variables EV and q_MI and of the state variables pmi and MFB50.

Figure 1B:
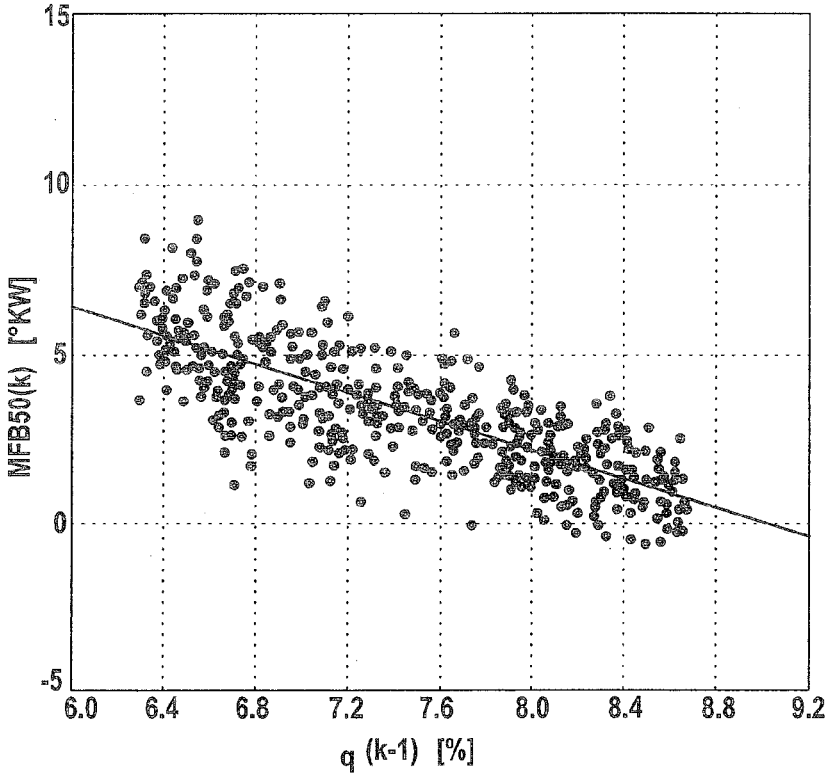

With regard to the quantity of fuel injected, it should be pointed out that in CAI operation the 50% mass fraction burnt is greatly dependent on the quantity of fuel injected in the preceding cycle. This is illustrated in FIGS. 1A and 1B. FIG. 1A shows the dependent relationship of the 50% mass fraction burnt MFB50 in the cycle k to the quantity of fuel injected in the same cycle k. FIG. 1B shows the dependent relationship of the 50% mass fraction burnt MFB50 in the cycle k to the quantity of fuel injected in the preceding cycle k−1. In FIGS. 1A and 1B, the 50% mass fraction burnt MFB50 is given in degrees crankshaft after TDC (top dead center) and the quantity of fuel injected is given as a percentage of a quantity injectable per cycle. FIG. 1A and FIG. 1B show the values for MFB50 obtained from measurements of the cylinder pressure in the case of a stochastic single parameter variation of the relative fuel quantity. The continuous lines in FIGS. 1A and 1B illustrate a linear correlation on the basis of the individual measured values. As is apparent from FIGS. 1A and 1B, the 50% mass fraction burnt MFB50 correlates only extremely weakly or not at all with the quantity of fuel injected in the same cycle, whereas the 50% mass fraction burnt MFB50 correlates significantly with the quantity of fuel injected in the preceding cycle. The reason for this lies in the coupling of successive cycles owing to the retention of residual gas. Put simply, a greater quantity of fuel injected in a given cycle leads to a higher combustion temperature and consequently to a higher temperature of the retained residual gas, with the result that auto-ignition occurs at an earlier crankshaft angle. One strength of the predictive closed-loop control described herein is that it takes such a coupling between the combustion cycles into consideration and is thus able to make improved regulation possible.

The data-driven model determined as described above may be used by model inversion for predictive closed-loop control as explained below.

Physical Model:

A physical model of the combustion process draws on physical principles for modeling. In this instance, for reasons of practicability, certain assumptions and simplifications are made, such as that pressure and temperature are approximately constant over the entire cylinder volume. The physical model lies, therefore, between a black box model and a white box model, the latter of which, for example, performs as accurately as possible a simulation of the modeled process on a finite element analysis. The physical model is therefore also referred to as a gray box model.

Figures 2A, 2B, 2C:
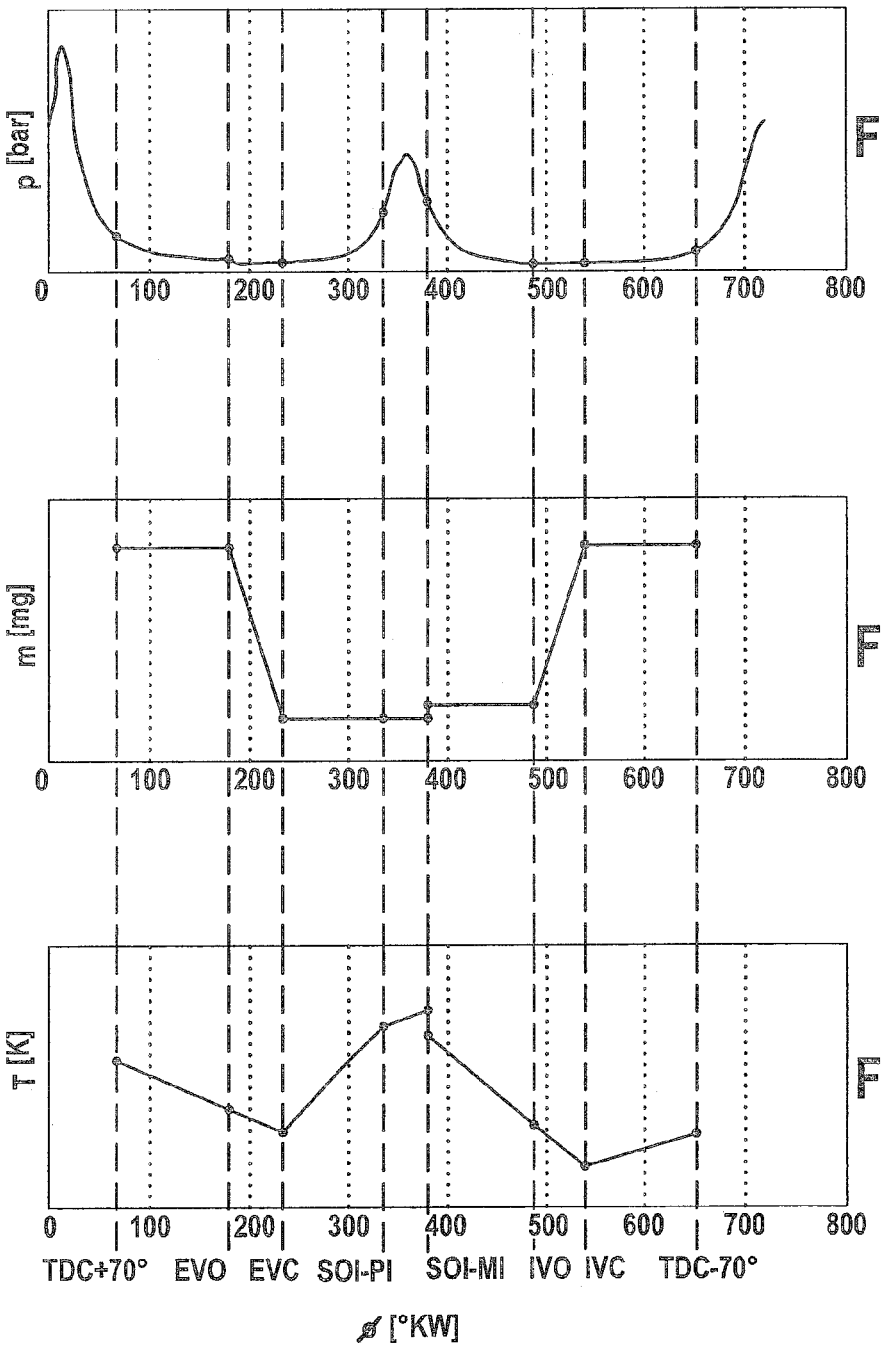
FIGS. 2A-2C illustrate the modeling of the predicted 50% mass fraction burnt on the basis of physical process parameters. In particular.

In the example under consideration, it is similarly the 50% mass fraction burnt MFB50 that is modeled. In other words, on the basis of certain physical process parameters of a combustion cycle, the 50% mass fraction burnt MFB50 in the following combustion cycle is predicted by the physical model. FIGS. 2A to 2C illustrate the modeling of the predicted 50% mass fraction burnt MFB50 on the basis of those physical process parameters. FIG. 2A shows a plot of the cylinder pressure p as a function of the crankshaft angle. FIG. 2B shows a plot of the gas mass m in the combustion chamber as a function of the crankshaft angle. FIG. 2C shows a plot of the gas temperature T in the combustion chamber as a function of the crankshaft angle. The x-axis in FIGS. 2A to 2C shows the crankshaft angle, ø. In addition, certain events are marked by vertical dashed lines, namely opening and closing of intake and exhaust valve (i.e., EVO, EVC, IVO and IVC) and start of pilot injection and main injection (SOI-PI and SOI-MI).

In the example under consideration, on conclusion of a combustion process at a predefined first crankshaft angle (e.g., 70° after TDC) certain physical parameters of the combustion are measured, for example the cylinder pressure p, which may be determined using a pressure gauge. Process parameters, for example, m(TDC+70°) and T(TDC+70°), that are not directly accessible to measurement, such as, for example, the gas temperature T or the gas mass m, are derived from the measurable physical parameters, where applicable, in combination with other stored or previously determined parameters. On the basis of those initial values p(TDC+70°), m(TDC+70°) and T(TDC+70°) the variation of the individual parameters is calculated, as illustrated in FIGS. 2A to 2C. In the variation calculation, physical principles are taken into consideration, especially the ideal gas law, the law of conservation of energy and the law of continuity, that is, especially the law of conservation of mass. In addition, the planned control interventions (EVO, EVC, etc.) are taken into consideration. This may be seen, for example, by the falling of the gas mass m between EVO and EVC in FIG. 2B. The variation of the process parameters p, m and T is modeled or predicted up to a predefined second crankshaft angle (e.g., 70° before TDC). From the values p(TDC−70°), m(TDC−70°) and T(TDC−70°) so calculated, it is then possible, for example using a previously determined and stored map, to determine the combustion position MFB50 for the next cycle k+1.

As with the data-driven model, control interventions planned from the physical model and also measured process parameters are used to predict a specific process feature (for example, MFB50) of the following combustion cycle. The physical model also may be used by model inversion for predictive closed-loop control, as will be explained below.

Figure 3:
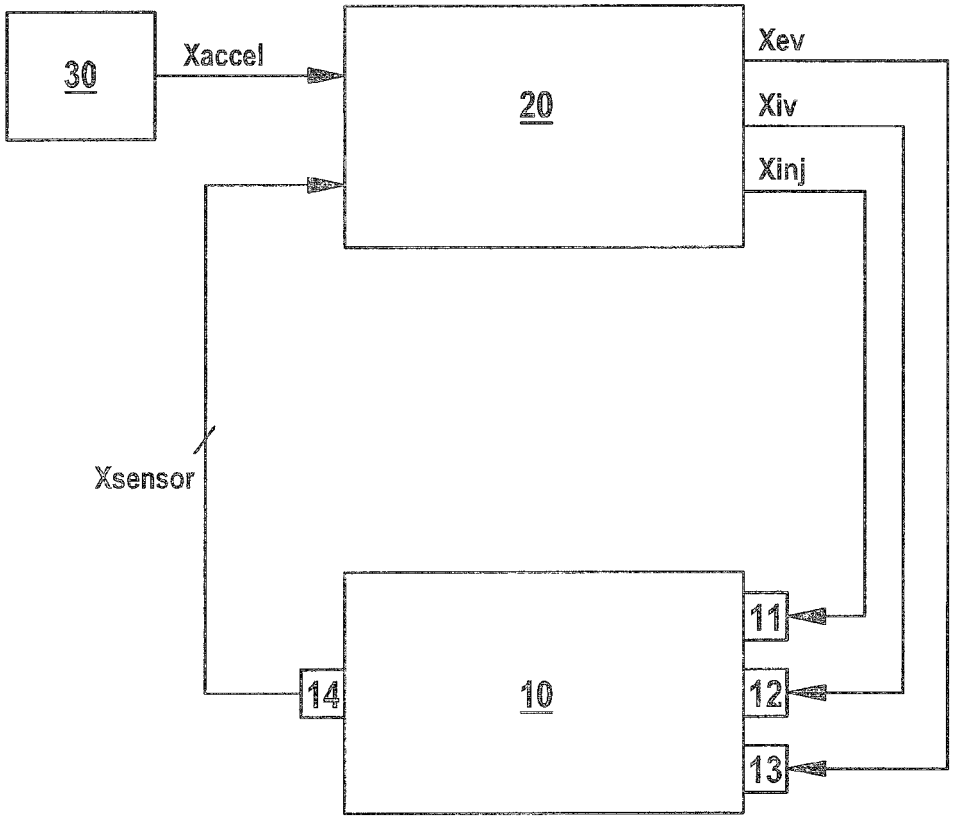
FIG. 3 shows schematically an internal combustion engine and a control unit for regulating the same.

Control Unit and Closed-Loop Control:

FIG. 3 shows schematically an internal combustion engine 10 and a control unit 20 for regulation thereof. Internal combustion engine 10 is preferably operable in CAI operation at least over a part-load range. Internal combustion engine 10 has a plurality of final control elements 11, 12, 13, which may, for example, include an injection actuator 11 with which fuel may be injected into a combustion chamber of the engine, an intake valve 12 and an exhaust valve 13 with which the supply of air to the combustion chamber may be regulated. Using the final control elements 11, 12, 13 it is possible to control the combustion process in the combustion chamber. The final control elements 11, 12, 13 are acted upon by actuation signals Xinj, Xiv and Xev, respectively. For example, exhaust valve 13 is opened when the actuation signal Xev assumes a predetermined first value and is closed when the actuation signal Xev assumes a predetermined second value.

Engine 10 further has a plurality of sensors 14 (only one sensor is shown here by way of example), which supply various sensor signals, Xsensor, for example, crankshaft angle, cylinder pressure, lambda signal, fresh air mass and temperature, to engine control unit 20. A sensor 30 is also provided, which determines a driver command (e.g., pressing down of the accelerator pedal) and supplies it as a driver command signal or load signal, Xaccel to control unit 20.

From the sensor values Xsensor supplied and from the driver command signal Xaccel, control unit 20 determines manipulated variables EV and SOI on the basis of the predictive closed-loop control described hereinafter, and finally converts those manipulated variables into the actuation signals Xinj, Xev and Xiv applied to final control elements 11, 12 and 13.

It should be noted that the engine may especially be in the form of a multi-cylinder engine, in which case at least one or all of final control elements 11, 12, 13 are provided for each cylinder individually. In addition, for simplicity, actuation signals Xinj, Xic and Xev are illustrated as being calculated by control unit 20. It is equally possible, however, for a final stage (not shown) that is separate from control unit 20 to be provided, to which control unit 20 supplies the manipulated variables and which produces actuation signals Xinj, Xiv and Xev on the basis of those manipulated variables.

Figure 4:
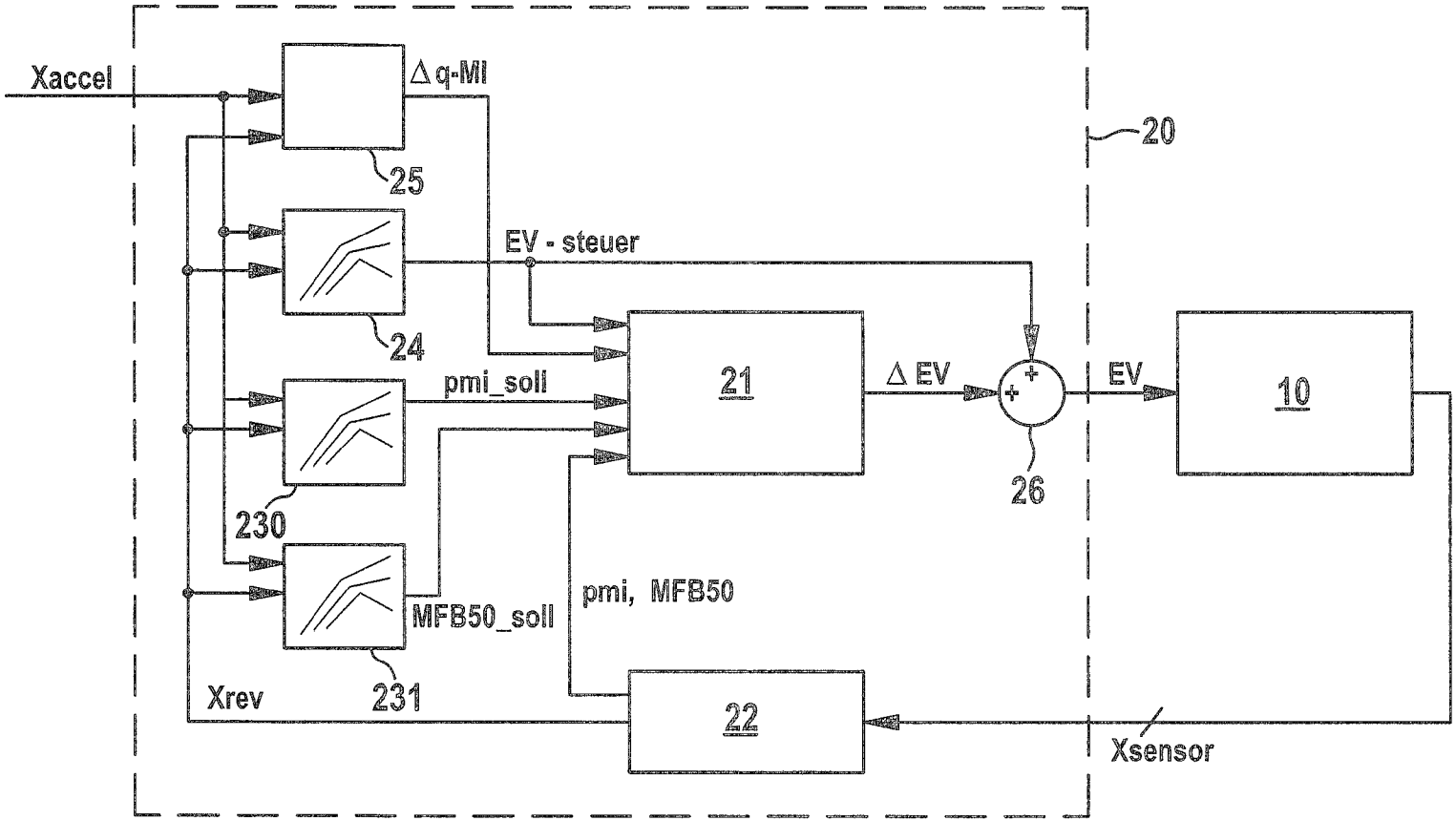
FIG. 4 shows a block diagram of a control unit representing an example of the implementation of predictive closed-loop control in the engine control unit.

FIG. 4 is a block diagram showing an example of implementation of predictive closed-loop control in engine control unit 20. Engine control unit 20 has a memory and a program-controlled device (e.g. a microcomputer) which executes programs stored in the memory. The individual blocks in engine control unit 20 in FIG. 4 are explained in the form of structural elements, but may also be software programs, parts of programs, or program steps executed by a program-controlled device. The arrows represent the information flow and signals.

Control unit 20 has a control device or controller 21, a feature calculation device 22, maps 24, 230 and 231, a fuel quantity calculation device 25 and an adder 26. In the example under consideration, control device 21 determines a correction value, ΔEV with which a control value, EV_control for the residual gas retention and/or air supply is corrected. The correction value ΔEV is determined by reference to an inverted system model. The model used as the basis in this instance is the data-driven model according to Equation 5, which is solved for ΔEV as follows:

$$\Delta EV(k)=(\Delta MFB50_pred(k)-b2\cdot\Delta q_MI(k;k-1)-b3\cdot\Delta pmi(k-1)-b4\cdot\Delta MFB50(k-1)/b1 \quad \text{(Eq. 6)},$$

where ΔEV(k) gives the correction value with which the control value EV_control(k) is corrected in the next cycle using an adder 26. In addition, the deviation ΔMFB50_pred of the predicted MFB50 value from the desired value is advantageously to be set to 0, i.e., on applying the calculated correction ΔEV(k) the predicted MFB50 value would correspond exactly to the desired MFB50 value (MFB50_pred(k) =MFB50_desired(k) or ΔMFB50_pred(k)=0). There is therefore determined as the manipulated variable, a value at which the difference between the desired value of the combustion position and the model-based predicted combustion position is minimized. This may be done, for example, by an iterative approximation to a minimum value.

The other parameters required to calculate ΔEV(k) are determined as follows: Feature calculation device 22 is supplied with sensor signals Xsensor which, as mentioned above, contain information on the crankshaft angle, the cylinder pressure and other measured values. From those measured values, feature calculation device 22 determines process parameters that are not directly measurable, such as, for example, the engine speed, Xrev, which is determined from the crankshaft angle, the 50% mass fraction burnt MFB50 and the indicated mean pressure pmi. As an alternative to calculation of pmi by feature calculation device 22, it is also possible for the driver command load Xaccel to be converted into an equivalent pmi_desired value. The actual values of the indicated mean pressure pmi and of the 50% mass fraction burnt MFB50 are output by feature calculation device 22 to control device 21 and the engine speed Xrev is output by feature calculation device 22 to maps 230, 231, 24 and to fuel quantity calculation device 25. Using map 24, a control value EV_control is determined on the basis of the engine speed Xrev and the load Xaccel, and is supplied to control device 21 and to adder 26. Map 230 determines, on the basis of the engine speed Xrev and the load Xaccel, the desired value pmi_desired of the indicated mean pressure, which is supplied to control device 21. Using map 231, the desired value MFB50_desired of the 50% mass fraction burnt is determined on the basis of the engine speed Xrev and the load Xaccel and is likewise supplied to control device 21.

In addition, the load Xaccel, which indicates the driver command, is input into fuel quantity calculation device 25, which calculates the quantity of fuel q(k) to be metered in during the next cycle. On the basis of the quantity of fuel q(k) to be metered in and the quantity of fuel q(k−1) metered in during the preceding cycle, fuel quantity calculation device 25 further calculates the value Δq_MI(k;k−1):

$$\Delta q_MI(k;k-1)=q(k)-q(k-1) \quad \text{(Eq. 7).}$$

Fuel quantity calculation device 25 supplies the value Δq_MI(k;k−1) to control device 21. As an alternative, it is also possible for control device 21 to calculate the value Δq_MI(k;k−1). Parameters b1, b2, b3, b4 are operating-point-dependent, are determined by reference to corresponding maps (not shown), and are input into control device 21. Control device 21, accordingly, has available to it all the values for calculation of the correction value ΔEV(k) on the basis of Equation 3. The correction value ΔEV(k) calculated by control device 21 is added by adder 26 to the control value EV_control and the resulting value EV(k) is converted into a corresponding actuation signal which is applied to final control element 13.

One advantage obtained with the regulation described above is that the predictive closed-loop control acts from cycle to cycle and thus makes rapid and accurate regulation for dynamic operation possible, that is, at abrupt changes in load or at changeovers in operation type.

The foregoing remarks have given an explanation of an inverted system model on the basis of a data-driven model based on Equation 5, but it is equally possible to use the model based on Equation 3 or to use a physical model. In the case of the physical model, the correction value ΔEV and the manipulated variable EV may be determined iteratively. For this, first the model is calculated for a predefined manipulated value EV and, as the next step, the manipulated value EV is varied and the resulting predicted 50% mass fraction burnt MFB50 is determined. It is then possible for the optimum manipulated value EV to be determined by specifically varying the manipulated value EV on the basis of the manipulated-value-dependent predicted 50% mass fraction burnt MFB50 until the predicted 50% mass fraction burnt MFB50_pred has only a minimal deviation from the desired 50% mass fraction burnt MFB50_desired. Known mathematical methods for iterative optimization may be used for this.

Figure 5:
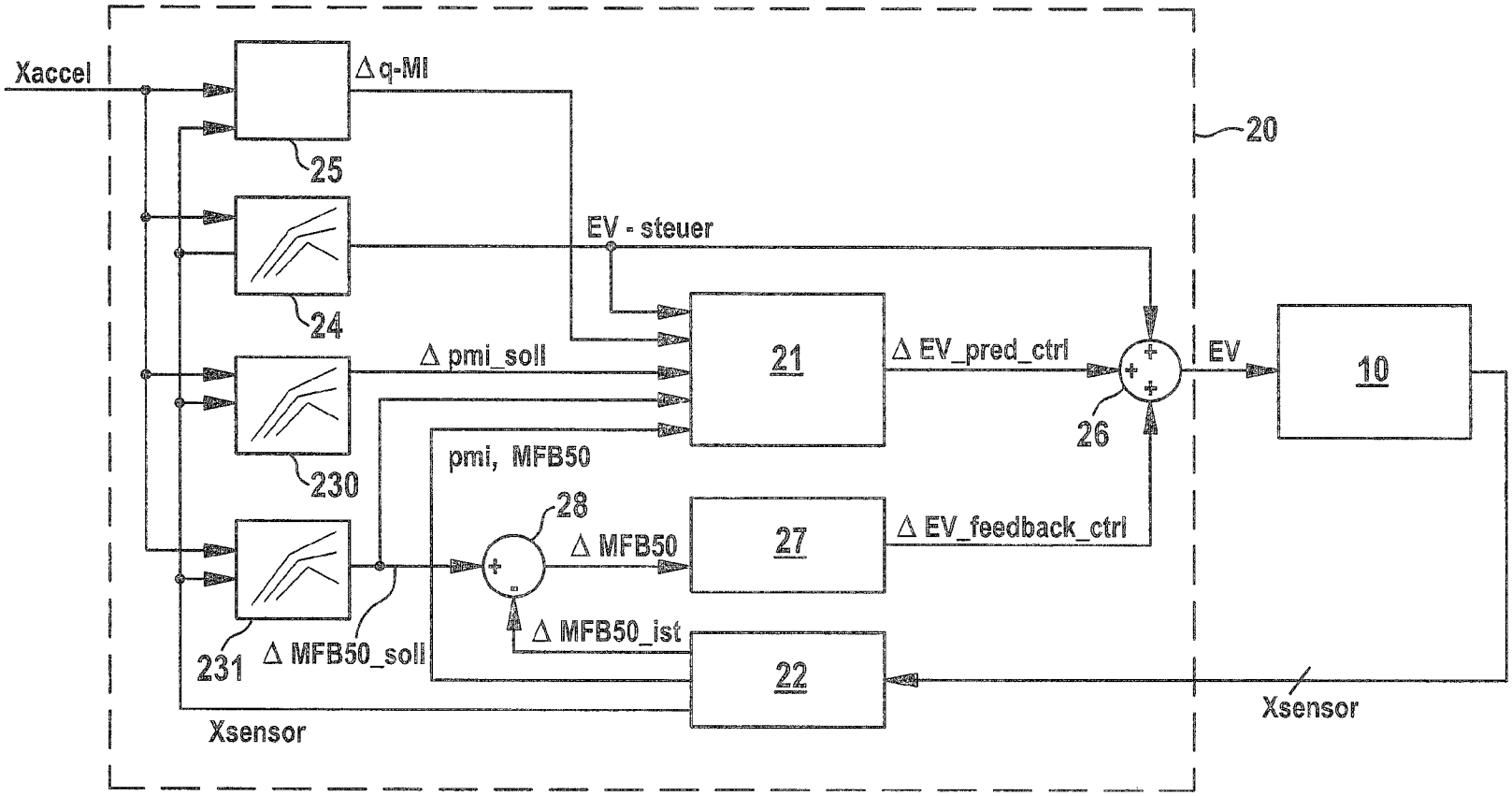
FIG. 5 shows a block diagram of a control unit, showing an extension of predictive closed-loop control in the engine control unit.

The predictive closed-loop control described above may be combined with cylinder-individual, continuous regulation of the combustion process. FIG. 5 is a block diagram showing an exemplary embodiment in accordance with such an extension of the predictive closed-loop control in engine control unit 20.

In addition to the closed-loop control circuit described above for predictive closed-loop control, control unit 20 illustrated in FIG. 5 is provided with a closed-loop control circuit consisting of controlled system 10, feature calculation device 22, subtracter 28 and a further control device 27. Feature calculation device 22 determines the actual 50% mass fraction burnt value MFB50. Subtracter 28 determines a difference value, ΔMFB50 by subtraction of the actual value MFB50 from the desired value MFB50_desired and outputs the difference value ΔMFB50 to control device 27. Control device 27 carries out continuous regulation using the 50% mass fraction burnt MFB50 as the reference variable and determines a further correction value, ΔEV_feedback_ctrl on the basis of the difference value ΔMFB50. Control device 27 may be configured, for example, as a PID controller or the like. Adder 26 adds the correction value, ΔEV_pred_ctrl (which corresponds to ΔEV in FIG. 4) determined by control device 21, to the correction value ΔEV_feedback_ctrl determined by control device 27, and to the control value EV_control, and applies the resulting manipulated value EV to final control element 13 of engine 10.

It is advantageous here for control device 27 to determine cylinder-individual correction values ΔEV_feedback_ctrl which are respectively fed to the final control elements of the individual cylinders of engine 10. At the same time, control device 21 is able to determine a correction value ΔEV_pred_ctrl that is applied to all the cylinders of the engine. In this manner, final control elements 13 of the individual cylinders of the engine are therefore actuated by individual manipulated variables. This has the advantage that controller 21 acts on the basis of the predictive closed-loop control in a similar manner from cycle to cycle for all the cylinders and therefore, as described above, renders rapid regulation possible, whereas cylinder-individual controller 27 operates comparatively slowly, but permits finer regulation with respect to cylinder-individual differences. Altogether, therefore, rapid and precise regulation over all the cylinders is made possible.

Figure 6:
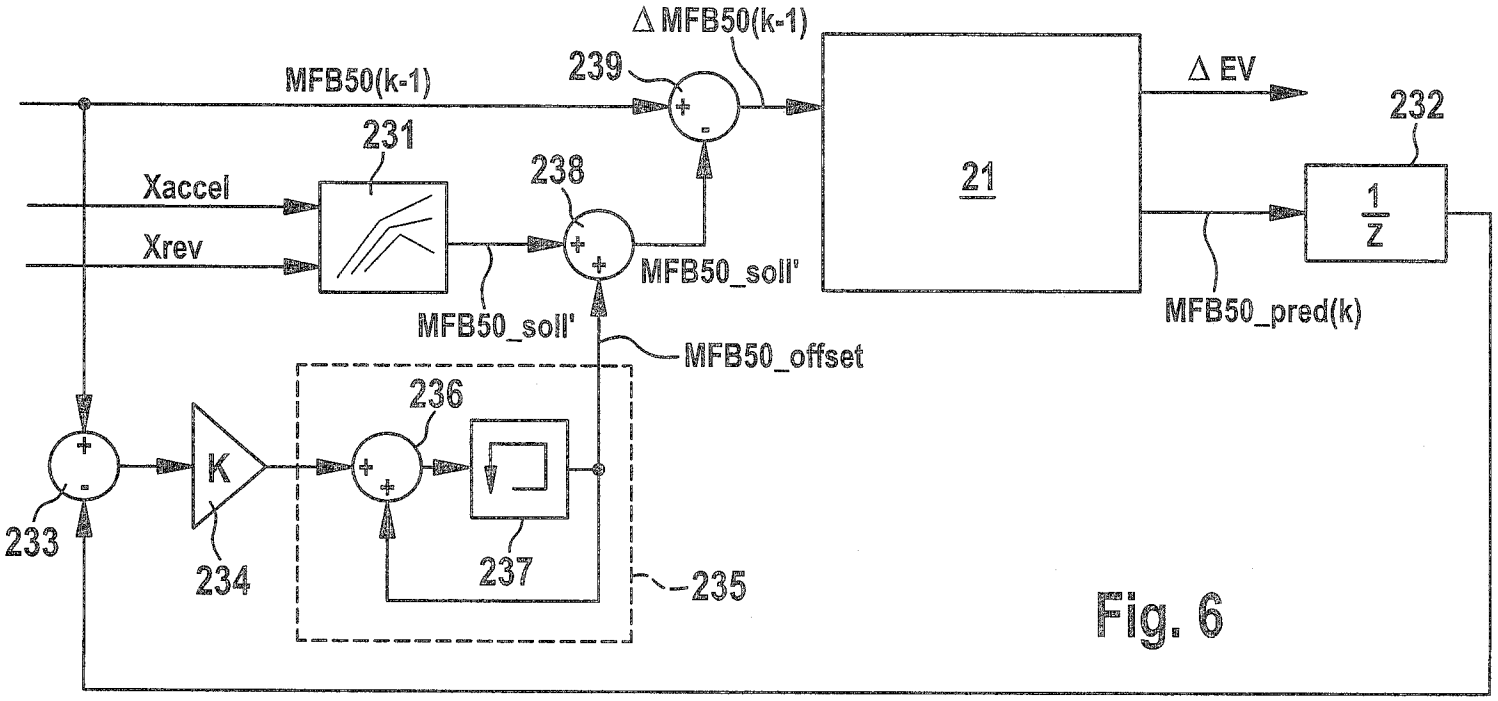
FIG. 6 shows a block diagram of a control unit representing an example of cylinder-individual offset correction of the desired value of the combustion position feature.

Cylinder-individual correction is also possible by correction of the desired value MFB50_desired by an offset correction value. In this case, the actual value MFB50 of a given combustion cycle (k−1) is compared with the predicted value MFB50_pred(k−1) determined and stored for that cycle and, from the difference between those two values, a cylinder-individual offset correction value is determined with which the desired value MFB50_desired of combustion cycles following that cycle is corrected. FIG. 6 shows schematically an implementation of a method involving correction by an offset correction value. FIG. 6 shows, in this regard, a detailed block diagram of control unit 20.

Control device 21 carries out model-based predictive closed-loop control in the manner described above. Instead of being supplied with the desired value MFB50_desired, however, control device 21 is supplied with the value ΔMFB50 (k−1)=MFB50 (k−1)−MFB50_desired' which is determined by a subtracter 239 by subtraction of a corrected desired value MFB50_desired', which corresponds to the sum of the desired value MFB50_desired and an offset correction value MFB50_offset, from the combustion position MFB50 (k−1). It is, of course, also possible for the values MFB50 (k−1) and MFB50_desired' to be supplied to control device 21 separately and for the value ΔMFB50 (k−1) to be determined by control device 21.

$$MFB50_desired' = MFB50_desired + MFB50_offset \quad \text{(Eq. 8)}$$

The offset correction value MFB50_offset is determined as follows: the predicted 50% mass fraction burnt MFB50_pred (k) of a given combustion cycle is delayed with a delay element 232 by a period of time corresponding to a combustion cycle. Delay element 232 may also be in the form of a memory. A subtracter 233 subtracts the delayed predicted 50% mass fraction burnt MFB50_pred(k) from the actual value of the 50% mass fraction burnt MFB50 (k−1) determined by feature calculation device 22 for the preceding cycle. Subtracter 233 subtracts, therefore, the value predicted for a given cycle from the actual value of the 50% mass fraction burnt for that cycle.

The difference determined by subtracter 233 is fed to a multiplier 234 which multiplies the difference by the constant K. An integrator 235 integrates the result of the multiplication. The integrator 235 may, for example, have an adder 236 and a memory 237. Memory 237 stores the output value of adder 236 and is updated once per combustion cycle. Adder 236 adds the output value of multiplier 234 to the output value of memory 237. The output value of memory 237 is the correction value MFB50_offset. An adder 238 adds the correction value MFB50_offset to the desired value MFB50_desired and outputs the corrected desired value MFB50_desired' to subtracter 239.

The desired value MFB50_desired is corrected for each cylinder individually. For this reason, at least elements 232 to 239 of the control unit illustrated in FIG. 6 are cylinder-individual, that is, provided separately for each cylinder of internal combustion engine 10. Control device 21 is therefore supplied with a value ΔMFB50 (k−1) for each cylinder, and control device 21 calculates a predicted 50% mass fraction burnt MFB50_pred for each cylinder individually. For the purposes of a clearer understanding, this calculation is shown in FIG. 6 representatively for only one cylinder. As far as map 231 is concerned, it is possible for only one map 231 to be provided for all the cylinders. This has the advantage that resources such as, for example, memory capacity may be saved. As an alternative, it is also possible for a separate map 231 to be provided for each cylinder. This has the advantage that cylinder-individual differences resulting, for example, from differing position or geometries regarding the intake diversity of the air system of the cylinders may already be taken into consideration in the application phase.

In operation, the actual value (or the value determined on the basis of measured values) of the combustion position MFB50 is compared with the predicted combustion position, and on the basis of the difference between those two values an offset correction value MFB50_offset is determined. The combination of multiplier 234 and integrator 235 has the effect of eliminating statistical variation in the combustion position. The smaller the constant K of multiplier 234 is, the less sensitive is the offset correction value MFB50_offset to statistical variations, though smaller constants K will also have the effect of slower adaptation of the offset. The constant K may be, for example, from 0.0001 to 0.1. Instead of multiplier 234 and integrator 235, it is also possible for the offset correction value MFB50_offset to be determined as a mean value of the difference between predicted value and actual value, averaged over a specific number of cycles (e.g. from 10 to 10000). Smoothing of the offset correction value MFB50_offset is also possible, by providing a low-pass filter, for example a PT1 filter or PT2 filter, instead of multiplier 234 and integrator 235.

Using the method described above it is possible to compensate for cylinder-individual differences in the combustion behavior by a correction of the desired value of the combustion position.

Furthermore, the correction is adaptive, i.e., time-variant changes in the combustion behavior occurring as a result of aging processes or the like may be corrected. The offset correction preferably proceeds continuously concurrently with operation of the engine, which makes continual cylinder-individual optimization possible. In a development, the cylinder-individual desired values MFB50_desired' so determined may also be stored in maps. This has the advantage that the above-mentioned cylinder-individual differences do not need to be taken into consideration in the basic application phase, but are learned by the engine control automatically in operation.

The cylinder-individual offset correction was explained above for the data-driven model, but may also be applied to the physical model explained above.

If the above-described closed-loop control is applied to an engine that is operated in CAI operation only in a part-load range, it is advantageous for the predictive closed-loop control to be carried out by control device 21 only when the engine is in CAI operation. This may be achieved by control unit 20 first establishing whether the engine is in CAI operation or in SI operation, for example by querying an internal status signal. If control unit 20 establishes that the engine is in SI operation, the part of the program carried out by controller 21 is not executed and ΔEV_pred_ctrl is set to zero. If control unit 20 establishes that the engine is in CAI operation, the CAI closed-loop control described above is carried out. In this manner it is possible to save resources in the control unit 20 in SI operation. Furthermore, it is also possible to carry out predictive closed-loop control also when a changeover between CAI operation and SI operation takes place. This may be achieved by comparing the operating mode of the current cycle with the operating mode of the future cycle (for example by querying corresponding status signals) and carrying out the predictive closed-loop control also when those two operating modes differ.

Although the foregoing implementations of the present invention have been described with reference to preferred exemplary embodiments, the invention is not limited thereto, but may be modified in a variety of ways. In particular, various features of the configurations described above may be combined with one another.

For example, in the data-driven model described above, other features may be taken into consideration in addition to the variables mentioned, such as, for example, the 50% mass fraction burnt (or a comparable parameter indicative of the combustion position) and the operating mode (i.e., CAI or SI) of the preceding cycle. In addition, both models may be expanded by being supported by further measured quantities, for example the lambda signal determined by a lambda sensor, the fresh air mass supplied, which is measured by an air mass sensor, and/or the air temperature. Corresponding sensor signals Xsensor may be fed to the controller (not shown). In this case, the gas composition, for example, may be deduced from the values so determined. It should, however, be borne in mind that such an expansion of the model leads to additional calculation effort, which is relevant particularly in the case of the physical model in view of the fact that only a few milliseconds are available for the calculation process. It is ultimately advantageous, therefore, for a sufficient accuracy to be obtained with the minimum possible effort.

It was furthermore explained with reference to the physical model that estimation of the 50% mass fraction burnt MFB50 takes place at a crankshaft angle of TDC−70°. It may, however, also be carried out earlier, on the basis of intermediate results (e.g., OTDC) and as yet unprocessed control interventions (e.g., SOI_MI) using correspondingly modified maps.

What is claimed is:

1. A method for controlling an internal combustion engine that is operable, at least in a part-load range, in an operating mode with auto-ignition and a combustion process of which is influenced by a manipulated variable, the method comprising:

determining, by a control unit including a computer processor, a desired value of a combustion position feature of the combustion process of the engine;

determining, by the control unit, a target value of the manipulated variable by predictive closed-loop control based on a modeling of the combustion position feature as a function of the manipulated variable in the combustion process wherein the target value of the manipulated variable is determined as a value at which the difference between the desired value of the combustion position feature and a model-based predicted combustion position feature is minimized; and controlling, by the control unit, the engine operation by actuating at least one physical control component of the engine based on the target value of the manipulated variable.

2. The method as recited in claim 1, further comprising:

selecting the combustion position feature to correspond to a crankshaft angle at which a specific quantity of the combustion energy of a combustion cycle has been converted in a cylinder of the internal combustion engine.

3. The method as recited in claim 2, wherein the combustion position feature is the 50% mass fraction burnt, which corresponds to a crankshaft angle at which approximately 50% of the combustion energy of a combustion cycle has been converted in the cylinder of the internal combustion engine.

4. A non-transitory computer-readable storage medium containing program code configured to, when executed on a program-controlled device, cause the program-controlled device to perform the steps of a method for controlling an internal combustion engine that is operable, at least in a part-load range, in an operating mode with auto-ignition and a combustion process of which is influenced by a manipulated variable, the method comprising:

determining a desired value of a combustion position feature of the combustion process of the engine;

determining a target value of the manipulated variable by predictive closed-loop control based on a modeling of the combustion position feature as a function of the manipulated variable in the combustion process, wherein the target value of the manipulated variable is determined as a value at which the difference between the desired value of the combustion position feature and a model-based predicted combustion position feature is minimized; and controlling, by the control unit, the engine operation by actuating at least one physical control component of the engine based on the target value of the manipulated variable.

5. A control unit for an internal combustion engine, the control unit comprising:

a computer processor configured to perform the steps of a method for controlling an internal combustion engine, the internal combustion engine being operable, at least in a part-load range, in an operating mode with auto-ignition, and a combustion process of the internal combustion engine being influenced by a manipulated variable, wherein the method includes:

determining a desired value of a combustion position feature of the combustion process of the engine;

determining a target value of the manipulated variable by predictive closed-loop control based on a modeling of the combustion position feature as a function of the manipulated variable in the combustion process, wherein the target value of the manipulated variable is determined as a value at which the difference between the desired value of the combustion position feature and a model-based predicted combustion position feature is minimized; and controlling, by the control unit, the engine operation by actuating at least one physical control component of the engine based on the target value of the manipulated variable.

* * * * *